US011375312B2

(12) United States Patent
Xu et al.

(10) Patent No.: US 11,375,312 B2
(45) Date of Patent: Jun. 28, 2022

(54) METHOD, DEVICE, LOUDSPEAKER EQUIPMENT AND WIRELESS HEADSET FOR PLAYING AUDIO SYNCHRONOUSLY

(71) Applicant: Bestechnic (Shanghai) Co., Ltd., Beijing (CN)

(72) Inventors: Mingliang Xu, Beijing (CN); Liang Zhang, Beijing (CN); Weifeng Tong, Beijing (CN); Hua Zeng, Beijing (CN); Fei Luo, Beijing (CN); Qianli Ma, Beijing (CN); Yifeng Xiao, Beijing (CN); Lei Yang, Beijing (CN)

(73) Assignee: BESTECHNIC (SHANGHAI) CO., LTD., Beijing (CN)

( * ) Notice: Subject to any disclaimer, the term of this patent is extended or adjusted under 35 U.S.C. 154(b) by 354 days.

(21) Appl. No.: 16/704,468

(22) Filed: Dec. 5, 2019

(65) Prior Publication Data

US 2021/0067874 A1 Mar. 4, 2021

(30) Foreign Application Priority Data

Aug. 26, 2019 (CN) ..... 201910788718.4

(51) Int. Cl.
*H04R 3/12* (2006.01)
*H04R 5/02* (2006.01)
*H04R 5/04* (2006.01)

(52) U.S. Cl.
CPC ..... *H04R 3/12* (2013.01); *H04R 5/02* (2013.01); *H04R 5/04* (2013.01); *H04R 2420/07* (2013.01)

(58) Field of Classification Search
CPC ..... H04R 3/12; H04R 2420/07
See application file for complete search history.

(56) References Cited

U.S. PATENT DOCUMENTS

2006/0215664 A1* 9/2006 Iwase ..... H04L 12/6418 370/395.64
2009/0298420 A1* 12/2009 Haartsen ..... H04J 3/0658 455/3.06
2014/0064513 A1* 3/2014 Behringer ..... H03G 3/3026 381/77
2017/0098466 A1* 4/2017 Elliot ..... H04R 27/00
2018/0165056 A1* 6/2018 Lay ..... H04W 56/005
2018/0167757 A1* 6/2018 Yu ..... G06F 3/165
2018/0359719 A1* 12/2018 Tanaka ..... H04H 20/63

FOREIGN PATENT DOCUMENTS

CN 101202608 A 6/2008
CN 108337074 A 7/2018

* cited by examiner

*Primary Examiner* — Nathan M Cors
(74) *Attorney, Agent, or Firm* — Haynes and Boone, LLP

(57) ABSTRACT

A method realizes synchronous playing of audio data from an audio source by two or more wireless speakers. The method includes receiving at each of the wireless speakers first audio data packets sent by the audio source and determining a respective first time point for the receiving of the first audio data packets; processing the first audio data packets at each of the wireless speakers to generate respective second audio data packets, the second audio data packets each including audio data to be played with a fixed data length; setting a delayed play time and obtaining a playing time point at each of the wireless speakers, the obtaining of the playing time point being based on the respective first time point and the respective delayed play time; and playing the second audio data packets at each of the wireless speakers at the respective playing time point.

20 Claims, 9 Drawing Sheets

METHOD, DEVICE, LOUDSPEAKER EQUIPMENT AND WIRELESS HEADSET FOR PLAYING AUDIO SYNCHRONOUSLY

CROSS-REFERENCE TO RELATED APPLICATION

This application claims priority under 35 U.S.C. § 119(a) to a Chinese Patent Application filed in the Chinese Patent Office on Aug. 26, 2019 and assigned Serial No. 2019107887184, the disclosure of which is incorporated herein in its entirety by reference.

TECHNICAL FIELD TECHNICAL FIELD

The present invention relates to the field of audio processing, in particular to an audio synchronous playing method and device, speaker equipment and wireless headset.

BACKGROUND OF THE TECHNOLOGY

At present, one implementation method of true wireless headsets is that intelligent devices and left and right headsets respectively carry out data transmission (which can be music, voice or data packets, etc.) through Bluetooth connection. For example, when playing stereo music, the intelligent device transmits the music to the left and right headsets respectively. However, the left and right headsets belong to two subsystems, which are implemented in two different chips and have separate clock systems.

Therefore, in the existing true wireless headset system, it is often difficult to achieve better synchronization between the left ear and the right ear. For example, when playing music or voice calls, the music or voice of the left and right ears cannot be accurately played at the same time, which greatly affects the playing quality.

SUMMARY

The present invention discloses a method and a device for synchronously playing audio signals, a wireless loudspeaker device and a wireless headset, so as to solve the problem that the existing synchronization method is not accurate enough.

In order to achieve the above purpose, the embodiment of the present invention provides an audio synchronous playing method, which is used for realizing synchronous playing of audio data from the same audio source by two or more wireless loudspeakers. For any one of the two or more wireless loudspeakers, the method comprises the following steps: receiving a first audio data packet sent by an audio source, and determining a first time point of receiving the first audio data packet; processing the first audio data packet to generate a second audio data packet, wherein the second audio data packet comprises the audio data to be played with a fixed data length; setting a delayed play time, obtaining the playing time point of the second audio data packet according to the first time point and the delayed play time, and playing the audio data to be played in the second audio data packet at the playing time point.

Further, in an embodiment, receiving the first audio data packet sent by the audio source includes: receiving the first audio data packet within a fixed time interval, and setting the maximum retransmission times within the fixed time interval which the first audio data packet is in. Further, in an embodiment, receiving the first audio data packet sent by the audio source, including: setting a fixed time point within the fixed time interval, and receiving the first audio data packet transmitted for the first time or retransmitted.

Further, in an embodiment, determining a first time point of receiving the first audio data packet includes: for any one of the two or more wireless speakers, taking the fixed time point where it receives the first audio data packet for the first time in the fixed time interval as the first time point.

Further, in an embodiment, processing the first audio data packet to generate the second audio data packet includes: performing data decompression processing on the first audio data packet, to generate the second audio data packet of the fixed length audio data to be played.

Further, in an embodiment, the data length of the to-be-played audio data in the second audio data packet after the decompression process is set corresponding to the set time length of the fixed time interval. The length of the audio data played during the fixed time interval is equal to the data length of the to-be-played audio data in the second audio data packet.

Further, in an embodiment, setting the delayed play time includes: set the length of the delayed play time to be not less than the length of time between the time point of the last retransmission of the first audio packet in the fixed time interval and the first time point.

Further, in an embodiment, the playing time point of the second audio data packet is obtained according to the first time point and the delayed play time, including: delay the delayed play time from the first time point, giving the playing time point of the second audio data packet.

Further, in an embodiment, before the two or more wireless speakers receive the first audio data packet sent by the audio source also includes: synchronizing the transceiver clocks of the two or more wireless speakers.

Further, in an embodiment, for any one of the two or more wireless speakers, playing the to-be-played audio data in the second audio data packet at the playing time point includes: Synchronizing the audio clock thereof with the transceiver clock; playing the audio data to be played in the second audio data packet according to the audio clock.

Further, in an embodiment, the two or more wireless speakers establish a wireless connection with the audio source; the wireless connection includes one or several of the means such as ordinary Bluetooth, Bluetooth low energy, physical layer improved Bluetooth, WIFI, and near field communication.

Further, in an embodiment, the two or more wireless speakers include a main wireless speaker and a subordinate wireless speaker; thereof: the main wireless speaker establishes a first Bluetooth connection with the audio source, the main wireless speaker establishes a second Bluetooth connection with the subordinate wireless speaker; the main wireless speaker transmits relevant parameters of the first Bluetooth connection to the subordinate wireless speaker to enable the subordinate wireless speaker to intercept and receive audio data packets from the said audio source.

In order to achieve the above purposes, an embodiment of the present invention also provides an audio synchronization playing device, configured to realize the synchronous play of audio data from the same audio source by two or more wireless speakers, the audio synchronization playing device includes: a receiving time point determining module for receiving the first audio data packet sent by the audio source, and determining the first time point of receiving the first audio data packet; an audio data processing module configured to process the first audio data packet to generate a second audio data packet, wherein the second audio data packet includes the fixed length audio data to be played; a playing time point generating module configured to set a delayed play time, the playing time point of the second audio data packet is obtained according to the first time point and the delayed play time, then play the audio data to be played in the second audio data packet at the obtained playing time point.

In order to achieve the above purposes, an embodiment of the present invention also provides a wireless speaker device, including a play device and a processor; the processor implements an audio synchronization play method as described in the foregoing embodiment; after the playing time point of the second audio data packet is obtained by the processor, the play device plays the audio data to be played in the second audio data packet at the playing time point.

In order to achieve the above purposes, an embodiment of the present invention further provides a wireless headset, including a main headset and a subordinate headset, both of which include the wireless speaker device as described in the above embodiments.

The audio synchronization playing method disclosed in the embodiments of the present invention can be separately performed in each wireless speaker connected to the audio source, that is, each wireless speaker is synchronized with the transceiver clocks of other wireless speakers, when the audio data sent by the audio source is received, the audio synchronous playing method of the embodiment of the present application is used for synchronous audio play, and the data interaction between each wireless speaker is not required, so it can reduce the amount of data transmission between wireless speaker devices and power consumption of wireless speaker equipment. In addition, due to the unreliability of wireless transmission (main-subordinate transmission), the data transmission between the wireless devices is reduced, and the reliability of the system synchronous playback is also improved. Moreover, the audio playing time point obtained by each wireless speaker is based on the time point at which the audio data packet (air signal) is received on the basis of the transceiver clock synchronization, and thus the synchronization precision is high.

The specific embodiment of the present invention is disclosed in detail with reference to the following description and attached drawings, indicating the method in which the principles of the present invention can be adopted. It should be understood that the embodiments of the present invention are not limited therefore in scope. The embodiments of the present invention include many variations, modifications, and equivalents within the scope of the appended claims.

Features described and/or illustrated with respect to one embodiment may be used in one or more other embodiments in the same or similar manner, in combination with, or in place of, features in other embodiments.

It should be emphasized that the term "comprising" or "including", when used in this article, refers to the existence of features, whole parts, steps or components, but does not exclude the existence or addition of one or more other features, whole parts, steps or components.

DESCRIPTION OF THE DRAWINGS

In order to more clearly illustrate the technical solutions in the embodiments of the present invention or in the prior art, the drawings used in the embodiments or the description of the prior art will be briefly described below. Obviously, the drawings in the following description are only certain embodiments of the present invention, and those technical people in the field can obtain other drawings from these drawings without any inventive labor.

DETAILED DESCRIPTION OF THE EMBODIMENT

The technical solutions in the embodiments of the present invention are clearly and completely described in the following with reference to the accompanying figures appended in the embodiments of the present invention. It is obvious that the described embodiments are only a part of the embodiments of the present invention, but not all embodiments. All other embodiments obtained by those skilled in the art based on the embodiments of the present invention without creative efforts are within the scope of protection of the present invention.

Those skilled in the art will know that embodiments of the present invention can be implemented as a system, apparatus, device, method, or computer program product. Accordingly, the disclosure may be embodied in the form of an entirely hardware embodiment, an entirely software embodiment (including firmware, resident software, microcode, etc.), or an embodiment combining of software and hardware.

The principles and spirit of the present invention are explained in detail below with reference to a few representative embodiments of the present invention.

The audio synchronization playing method disclosed in the embodiment of the present invention is configured to implement synchronous play of audio data from the same audio source by two or more wireless speakers. In the present, the audio source may include any one of a cellular phone, a mobile PC, a tablet computer, a portable smart assistant, and a smart wearable device, and the audio signal from the audio source may be a voice signal of the cellular phone, or may be other audio signals played by smart terminal devices, such as music and video sounds. The wireless speaker device can be a wireless headset or a wireless loudspeaker, and any or several of the ordinary Bluetooth, Bluetooth low energy, physical layer improved Bluetooth, WIFI, near field communication (NFC) and low-band radios can be used for the wireless connection between the wireless speaker and the audio source or between every two wireless speakers.

Figure 1:
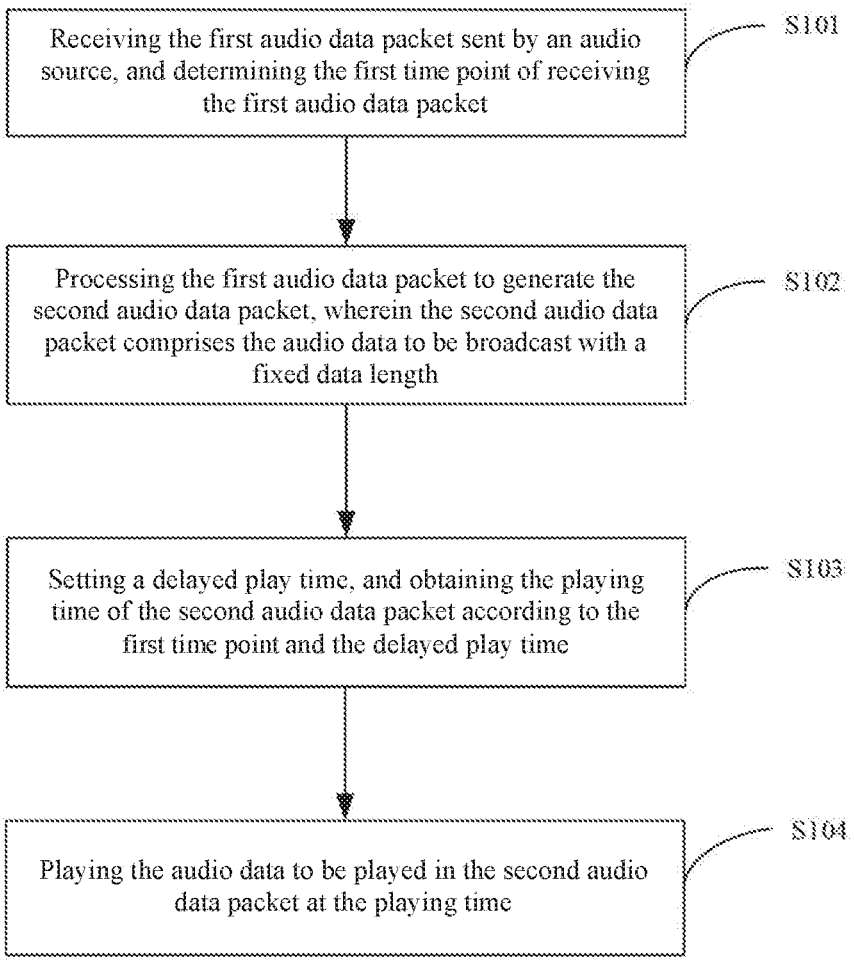
FIG. 1 is a flowchart of processing of the audio synchronization playing method according to an embodiment of the present invention.

FIG. 1 is a flowchart of the audio synchronization playing method according to an embodiment of the present invention. As shown in FIG. 1, the audio synchronization playing method of this embodiment is configured to implement synchronous play of audio data from the same audio source by two or more wireless speakers. For any one of the two or more wireless speakers, the audio synchronization playing method of the embodiment includes the following steps:

Step S101, receiving the first audio data packet sent by an audio source, and determining the first time point of receiving the first audio data packet; Step S102, processing the first audio data packet to generate the second audio data packet, wherein the second audio data packet includes the audio data to be broadcast with a fixed data length; Step S103, setting a delayed play time, and obtaining a playing time point of the second audio data packet according to the first time point and the delayed play time; Step S104, playing the audio data to be played in the second audio data packet at the playing time point.

It should be understood that the audio synchronous playing method of the embodiment of the present application is technically improved on the basis that the existing wireless speakers are independent subsystems respectively, so that the audio data from the same audio source can be synchronously played with two or more wireless speakers. That is to say, the audio synchronous playing method of this embodiment is executed separately in each wireless speaker, that is, when each wireless speaker receives the audio data sent by the audio source, it uses the audio synchronous playing method of this embodiment to perform synchronous playing of audio without data interaction between wireless speakers.

Specifically, in Step S101, the first audio data packet sent by the audio source is received for any one of the two or more wireless speakers, and the manner in which each wireless speaker receives the audio data packet from the audio source is related to the connection manner with the audio source.

Figure 2:
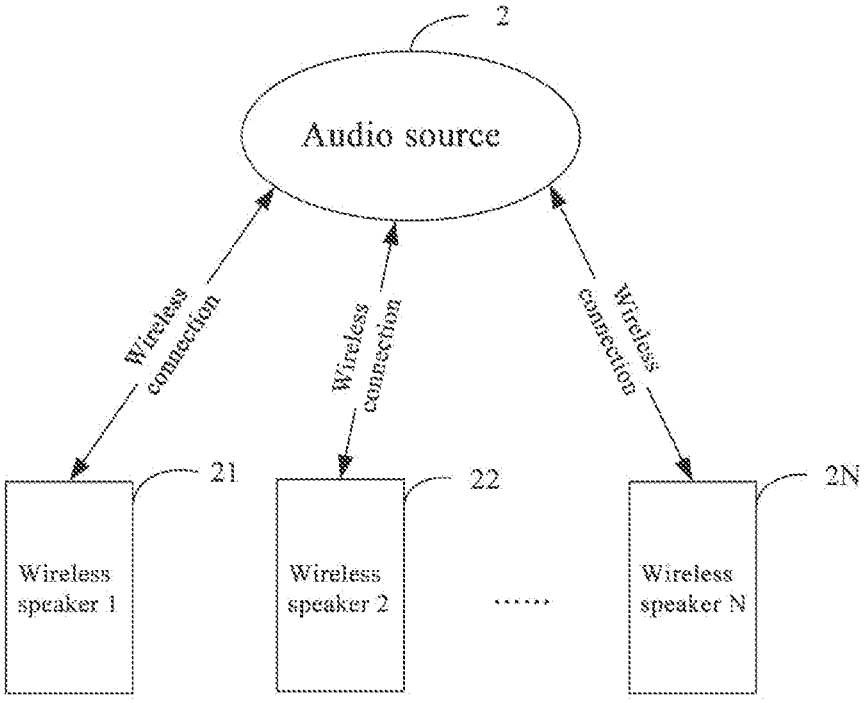
FIG. 2 is a system block diagram of the connection of audio and two or more wireless speakers in an embodiment of the present application.

As shown in FIG. 2, this is a system block diagram of the connection of audio and at least two wireless speakers in an embodiment of the present application. In this embodiment, the wireless speaker 21, the wireless speaker 22 . . . the wireless speaker 2N all establish wireless connections with the audio source 2 respectively, and the audio source 2 sends audio data packets to the wireless speaker 21, the wireless speaker 22 . . . the wireless speaker 2N respectively.

Figure 3:
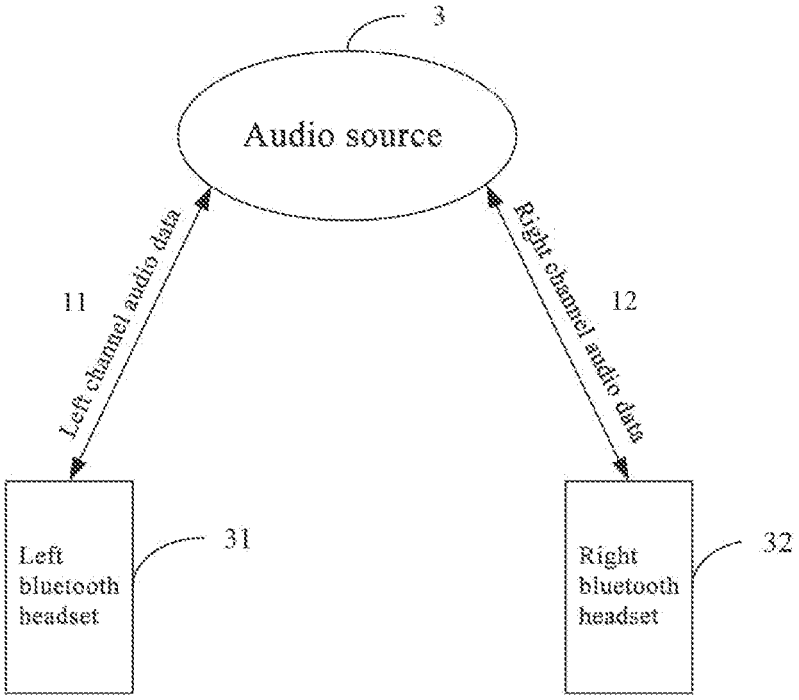
FIG. 3 is a system block diagram of a specific embodiment based on the embodiment shown in FIG. 2.

FIG. 3 is a system block diagram of a specific embodiment based on the embodiment shown in FIG. 2. In this specific embodiment, the audio source is a smart device 3, and the wireless speaker is two Bluetooth headsets, namely the left Bluetooth headset 31 and the right Bluetooth headset 32. In this embodiment, the left Bluetooth headset 31 and the right Bluetooth headset 32 respectively establish wireless connection with the smart device 3, and the wireless connection mode may be Bluetooth connection or WiFi connection. When transmitting audio data, the smart device 3 first preprocesses the audio data, i.e. encodes the audio signal and then separates the left channel audio data 11 and the right channel audio data 12, and then sends the left channel audio data 11 and the right channel audio data 12 to the left Bluetooth headset 31 and the right Bluetooth headset 32 respectively.

Figure 4:
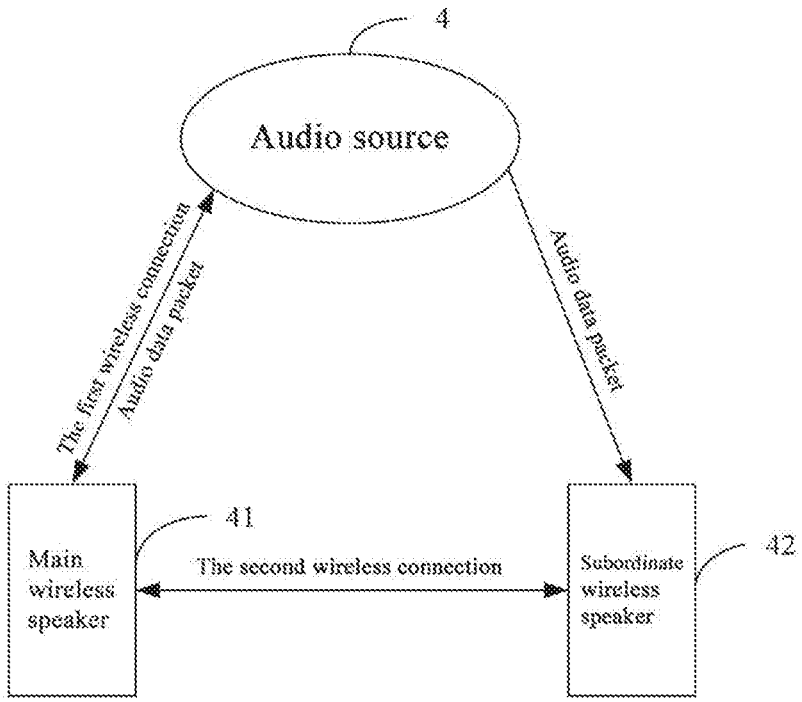
FIG. 4 is a block diagram of the system in which an audio source is connected to a main and a subordinate Bluetooth headset in another embodiment of the present application.

As shown in FIG. 4, this is a block diagram of the system in which an audio source is connected to a master and a slave Bluetooth headset in another embodiment of the present application; the wireless speaker includes two wireless Bluetooth headsets, namely, a main Bluetooth headset 41 and a subordinate Bluetooth headset 42. The main Bluetooth headset 41 establishes the first wireless connection with the audio source 4 and receives audio data packets transmitted by the audio source 4, the main Bluetooth headset 41 establishes the second wireless connection with the subordinate Bluetooth headset 42 and transmits the address of the audio source 4 and encryption parameters of the first wireless connection to the subordinate Bluetooth headset 42 so that the subordinate Bluetooth headset 42 intercepts and receives audio data packets transmitted by the audio source 4. In this embodiment, the audio source 4 transmits audio data to the main Bluetooth headset 41 through the first wireless connection, the subordinate Bluetooth headset 42 receives the relevant parameters of the first wireless connection sent by the main Bluetooth headset 41 and can "disguise as" the main Bluetooth headset 41 to communicate with the audio source 4. Both the main Bluetooth headset 41 and the subordinate Bluetooth headset 42 can directly receive audio data packets transmitted from the audio source 4.

However, regardless of the embodiment shown in FIGS. 2 and 3 or the embodiment shown in FIG. 4, each wireless speaker directly receives an audio signal transmitted from an audio source. That is, for the same audio signal transmitted from the audio source, the air reception time point at which each wireless speaker receives the same audio signal should be the same. In other words, the distance difference between the audio source and each wireless speaker is negligible with respect to the propagation speed of the audio signal (air signal).

Figure 5:
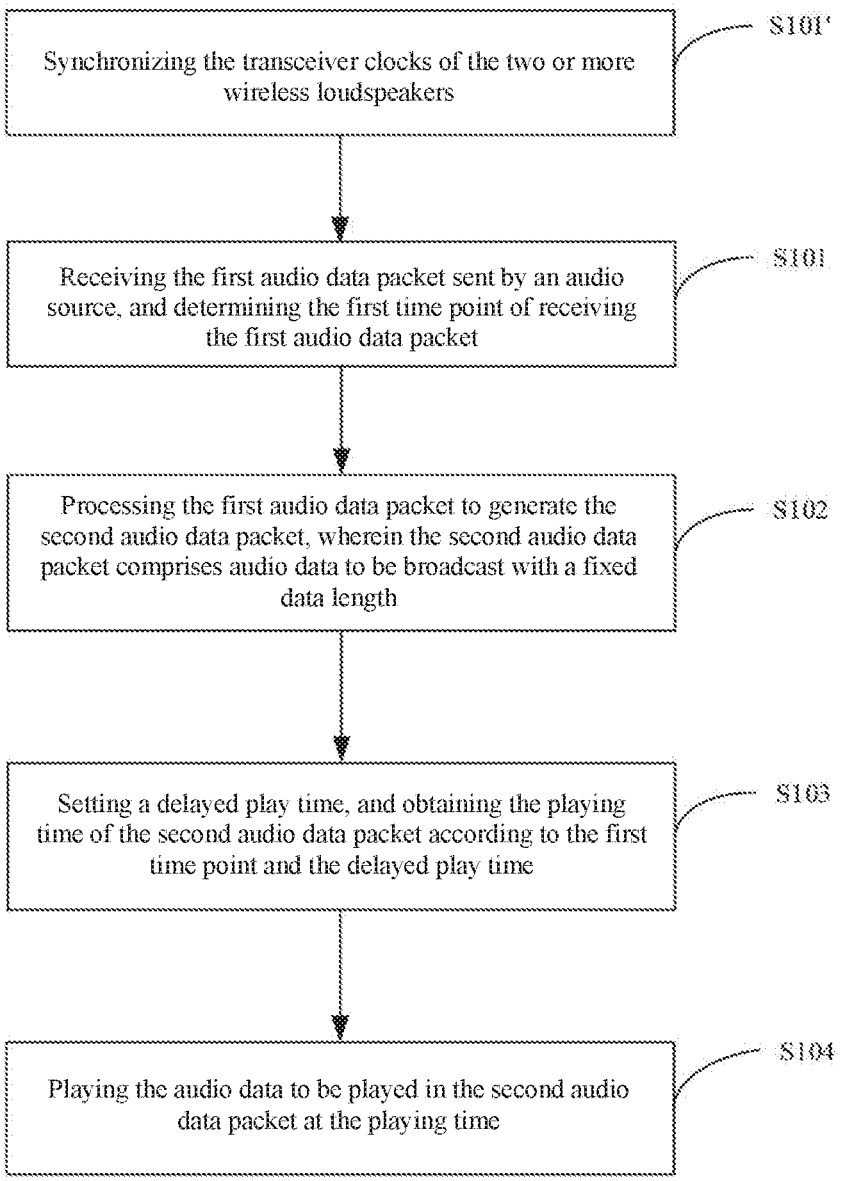
FIG. 5 is a flowchart of processing an audio synchronization playing method of another embodiment of the present invention.

In some embodiments, as shown in FIG. 5, before each of the two or more wireless speakers receives the first audio data packet transmitted by the audio source, it further includes: Step S101', synchronizing the transceiver clocks of the two or more wireless speakers. In the embodiment of the application, the clock of each wireless speaker and the clock of the audio source are usually synchronized respectively, thus indirectly realizing the synchronization of the transceiver clocks between the wireless speakers. Only when the transceiver clocks of all wireless speakers are synchronized can accurate synchronous reception of the same audio signal from the same audio source be realized.

Figure 6:
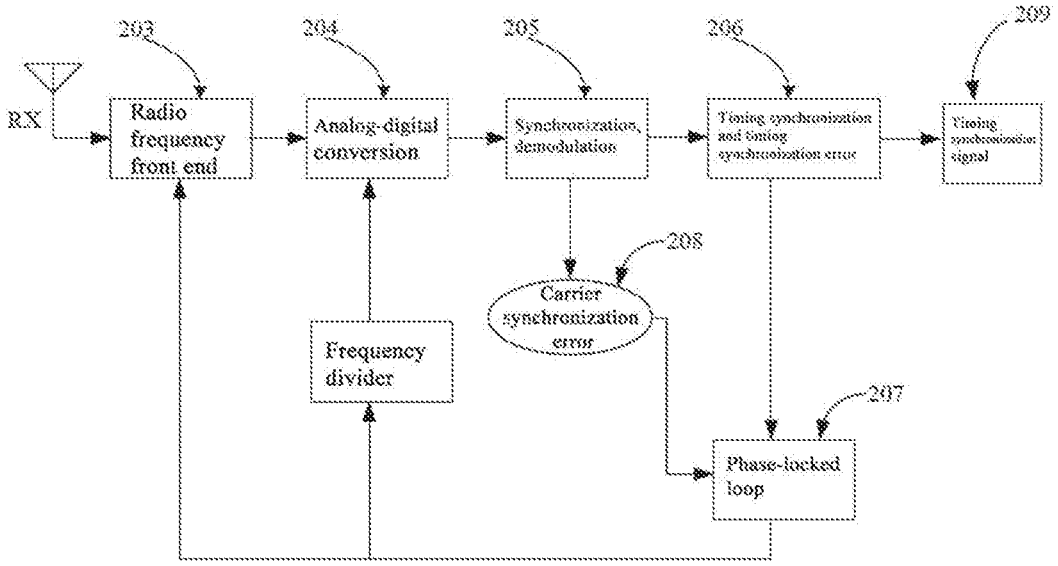
FIG. 6 is a flow chart of synchronizing the transceiver clocks of the main/subordinate Bluetooth headset with the audio source clock in an embodiment of the present invention.

FIG. 6 is a flow chart of synchronizing the transceiver clock of the master/slave Bluetooth headset with the audio source clock in an embodiment of the present invention. In this embodiment, two wireless speakers are respectively used as the main and subordinate Bluetooth headsets, and the Bluetooth connection between the main and subordinate Bluetooth headsets is taken as an example to explain.

In this embodiment, the audio signal sent by the audio source to the main Bluetooth headset and/or the subordinate Bluetooth headset may be a multi-slot packet or a single slot packet, but whether a multi-slot packet or a single slot packet is used, the audio signal sent by the audio source is always at the start time of a certain slot, and the duration of each slot is fixed (for example, the duration of each slot is 625 μs).

The main Bluetooth headset and the subordinate Bluetooth headset respectively convert the received radio frequency signals (radio frequency signals in the audio signal transmission process) to obtain timing synchronization signals, timing synchronization errors and carrier synchronization errors. Specifically, as shown in FIG. 6, the RF front end 203 receives RF signals, obtains digital audio signals through analog-to-digital conversion 204, and obtains timing synchronization signals 209, timing synchronization errors 206, and carrier synchronization errors 208 through synchronization and demodulation processing 205. Meanwhile, the start time of the timing synchronization signal 209 is synchronized with the start time of the slot where the audio source transmits the audio signal.

The timing synchronization error 206 and/or the carrier synchronization error 208 adjust the crystal oscillation frequency via the phase locked loop 207, and the demodulated signal after adjusting the crystal oscillation frequency via the phase locked loop 207 is fed back to the RF front end 203 and the frequency divider. After the above-mentioned signal synchronization processing, the main Bluetooth headset and the subordinate Bluetooth headset can be synchronized with the clock of the audio source respectively, thus indirectly realizing the synchronization of the Bluetooth clock (bt clk) of the main Bluetooth headset and the subordinate Bluetooth headset.

As mentioned above, after the synchronization of the transceiver clocks between the main and subordinate Bluetooth headsets is realized, the accurate synchronous reception of the same audio data sent by the audio source can be realized.

In step S101 of the embodiment of the present application, receiving the first audio data packet sent by the audio source may be to receive the first audio data packet within a fixed time interval and set the maximum retransmission times of the first audio data packet within the fixed time interval.

Figure 7:
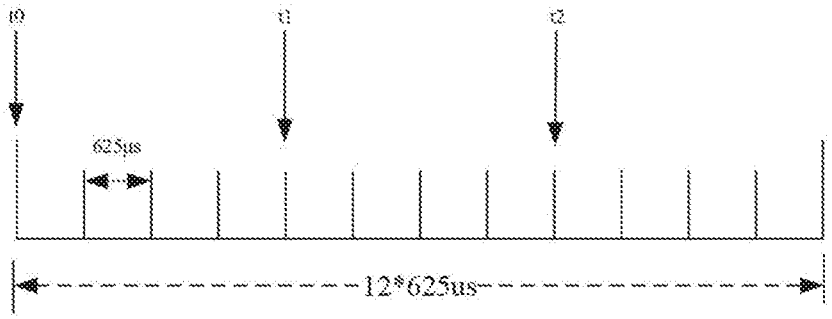
FIG. 7 is a time sequence diagram of the Bluetooth data transmission in an embodiment of the present invention.

Generally, wireless communication can be performed for a predetermined length of time period, and corresponding information is transmitted and received within each predetermined time period. In some embodiments, each predetermined time period may occupy one time slot or several time slots. In this application, Bluetooth transmission is taken as an example for explanation. According to Bluetooth protocol, the time of one slot is 625 μs. When using Advanced Audio Distribution Framework Profile (A2DP), a Bluetooth frame can often occupy multiple time slots; However, when using the Hands-free Framework Profile (HFP), it usually takes up one time slot. In some embodiments, as shown in FIG. 7, the fixed time interval for audio data transmission may be set to 12 Bluetooth time slots, i.e. 7500 μs, i.e. a certain audio data packet sent by an audio source may be received within the fixed time interval of 7500 μs.

In some embodiments, because the audio data is interfered by other factors in the transmission process, there is a possibility of data loss or receiving errors, so the audio source will resend the audio data when the wireless speaker does not receive the data or receives the erroneous data. As described above, the maximum retransmission times of an audio data packet within a fixed time interval can be set. If the audio data packet is not correctly received within the set maximum retransmission times, the audio data packet is not retransmitted and is considered lost. For example, an audio packet can be set to be sent up to three times in a fixed time interval. In some embodiments, the audio source can actively transmit the audio data N times according to the set maximum retransmission number N, that is, the audio data will be retransmitted within a fixed time interval regardless of whether the wireless Bluetooth device correctly receives the audio data; In other embodiments, the audio source can decide whether to retransmit according to the feedback of the wireless Bluetooth device. If a wireless Bluetooth device does not receive the audio data correctly, it sends a NACK signal to the audio source for retransmission. If it receives the audio data correctly, it sends an ACK signal to inform the audio source and the audio source will not retransmit. In this embodiment, for the embodiment shown in FIGS. 2 and 3, the audio source will not retransmit when and only when it receives ACK signals from all wireless speaker devices at the same time, and will retransmit as long as one wireless speaker device does not receive the audio data correctly.

In some embodiments of the present invention, in order to better realize synchronous reception of audio data packets by main and subordinate wireless devices, a fixed time point for receiving audio data packets within the fixed time interval may be set. In the embodiment shown in FIG. 7, if it is set that the audio data packet can be retransmitted three times within a fixed time interval (12 Bluetooth time slots), it can be specifically set that the first audio data packet is received at the starting time point of the first slot (time point t0), the second audio data packet is received at the starting time point of the fifth slot (time point t1), and the third audio data packet is received at the starting time point of the ninth slot (time point t2). It should be understood that the time interval for receiving audio data packets every two times may be the same (e.g., N slot lengths) or different (e.g., the time interval for receiving data for the first two times is 4 slot lengths, and the time interval for receiving data for the second time is 5 slot lengths).

In Step S101 of this embodiment, for any one of the two or more wireless speakers, the fixed time point at which the first audio data packet is first received within the fixed time interval is taken as the first time point. According to the above records, there is a possibility that the first audio data packet needs to be retransmitted multiple times within a fixed time interval due to the possibility of partial loss or partial error of the data packet in the data transmission process. In the embodiment of the present application, the time point when the first audio data packet is received is taken as the first time point for each wireless speaker device regardless of the number of times it needs to be retransmitted or whether the data it receives for the first time is correct. For example, referring to the embodiment shown in FIG. 7, if a certain audio data packet is received for the first time at the starting time point of the first slot set within a fixed time interval after the Bluetooth clock is synchronized, the first time point at which the audio data packet is received is the starting time point t0 of the first slot.

In the embodiment of the application, since the transceiver clocks of all wireless loudspeaker devices have been synchronized and are synchronized with the audio source clock, the first time point when all wireless loudspeaker devices receive the audio data packet is the same for the same audio data packet sent by the same audio source. After the first time point is obtained, in one embodiment, the time point information can be stored as a variable separately and the corresponding relation between the time point information and the audio data packet can be established. In this embodiment, the format of the audio data packet cannot be changed; In another embodiment, the time point information may also be added to the corresponding audio data packet (e.g., added to a blank field of the audio data packet), so that there is no need to separately establish the corresponding relationship between the time point information and the audio data packet. In the embodiment of the present application, the corresponding relation between the time point information and the audio data packet is established in order to keep the synchronization of audio data processing and playing with other wireless loudspeaker devices in the subsequent calculation and audio playing.

In some embodiments, the first audio data packet is processed in Step S102 to generate a second audio data packet. Specific operations include, but are not limited to, encoding operations, decoding operations, digital-to-analog conversion operations, buffering operations, decompression processing, and the like.

Wherein, the data decompression process for the first audio data packet decompresses the audio data to be played contained in the first audio data packet into a fixed data length. In this embodiment, the audio data to be played with a fixed data length can make the audio playing synchronization more accurate. More specifically, the data length of the audio data to be played in the decompressed second audio data packet may be set corresponding to the fixed time interval. The term of "set corresponding to" herein means that the length of the audio data played during the fixed time interval is equal to the data length of the audio data to-be-played in the second audio data packet.

In some embodiments, in Step S103, the delayed play time is set. The length of the delayed play time may be dynamically determined according to actual conditions, but in a preferred embodiment, the time length of the delayed play time is set to be not less than the length of time between the time point of the last retransmission of the first audio packet in the fixed time interval and the first time point. This implementation prevents one wireless speaker device from receiving audio data on the last retransmission while other wireless speaker devices are already playing audio data. And, from the first time point, the time point when the delayed play time is achieved is the playing time point of the to-be-played audio data in the second audio data packet. In this application embodiment, it is also necessary to establish the corresponding relationship between the playing time point and the second audio data packet, so as to accurately find and play the audio data to-be-played in the second audio data packet when the playing time point comes, so as to realize the synchronous play of the main and subordinate wireless speakers.

Through the synchronization method described in the above embodiments, the synchronization of transceiver clocks of all wireless speakers and the audio source can be realized, and the playing time point t of the audio data to-be-played can be obtained on the basis of the transceiver clock synchronization. In some embodiments, the time length Δt of the delayed play time of the wireless speaker may be set based on the transceiver clock or may be set based on the audio clock. Preferably, since the transceiver clock of the wireless speaker has been synchronized, the time length Δt of the delayed play time set based on the transceiver clock is more accurate.

In step S104 of the embodiment of the present invention, for any of the two or more wireless speakers, after obtaining the playing time point t of the audio data to be played in step S103, according to the respective audio clock (audio clk) the audio data to-be-played is read and played at the playing time point t.

Taking wireless speaker devices including main and subordinate Bluetooth devices as examples, it illustrates several implementations of main and subordinate Bluetooth devices synchronizing audio data according to their respective audio clocks.

(1) In the first embodiment, the audio clocks of the main Bluetooth device and the subordinate Bluetooth device can be synchronized with the respective Bluetooth clocks by an audio phase-locked loop (audio PLL) adjustment. Since the main and subordinate Bluetooth devices have implemented Bluetooth clock synchronization, the audio clocks of the main and subordinate Bluetooth devices adjusted by the audio phase-locked loop are also synchronized. Therefore, the main and subordinate Bluetooth devices can read and play the audio data to-be-played at the playing time point t according to the synchronized audio clock;

(2) In the second implementation, the main and subordinate Bluetooth devices use the size of the respective data cache as the input of the phase locked loop, and adjust the audio clocks of the main and subordinate Bluetooth devices according to the cache size, so as to synchronize the audio clocks of the main and subordinate devices. Therefore, the main and subordinate Bluetooth devices can read and play the audio data to-be-played at the playing time point t according to the synchronized audio clock;

(3) In the third embodiment, the synchronization of the audio data of the main and subordinate Bluetooth devices is not required, and simultaneous play of the audio data at the playing time point t can also be realized. Specifically, in these embodiments, the main and subordinate Bluetooth devices can adjust the data sampling rate through the respective resampling modules, so that the length of the data cache is consistent and the access speed is fixed, that is, the audio data is adjusted by adjusting the sampling rate. The length of the access time in the data cache is fixed. In this case, it is not necessary to adjust the audio clock synchronization, and the main and subordinate Bluetooth devices can read and play the audio data to-be-played at the playback time point t.

Figure 8:
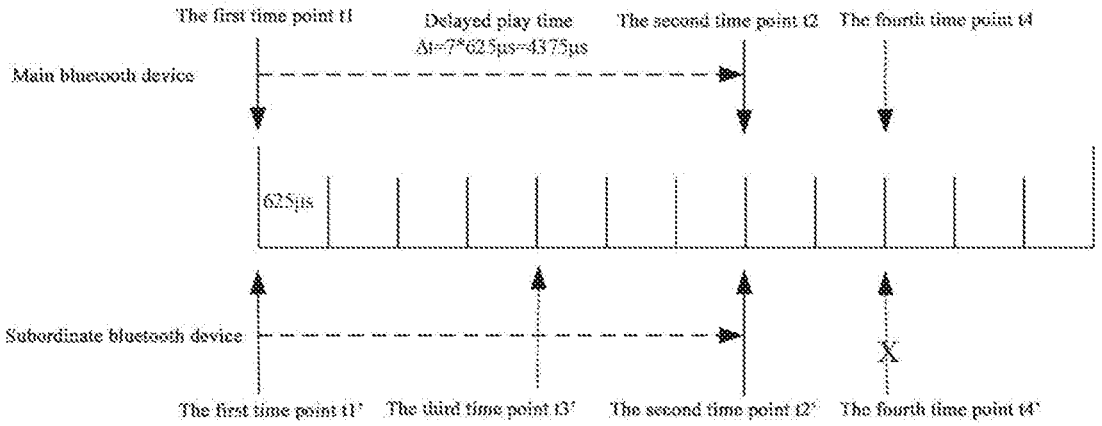
FIG. 8 is a sequence diagram of audio synchronous play of the embodiment of the present invention.

FIG. 8 is a sequence diagram of audio synchronous play of the embodiment of the invention, in which Bluetooth transmission is taken as an example to illustrate. The wireless speaker device of this embodiment is a wireless Bluetooth device, and according to the Bluetooth protocol, the time of one Bluetooth time slot is 625 μs. When using Advanced Audio Distribution Framework Profile (A2DP), a Bluetooth frame can often occupy multiple time slots; However, when using the Hands-free Framework Profile (HFP), it usually takes up one time slot. In the embodiment shown in FIG. 8, corresponding to the audio synchronization playing method in the foregoing embodiment of the present application, the fixed time interval set in the specific embodiment is the length of 12 Bluetooth time slots, that is, the fixed time interval=12*625 μs=7.5 ms, and the maximum retransmission times set in this fixed time interval are 3 times.

In this embodiment, the following situations exist in the audio synchronous play mode between the main and subordinate Bluetooth devices:

(1) The main Bluetooth device correctly receives the Bluetooth data packet at the first time point t1, and according to the set delay time Δt=7*625 μs=4375 μs, the main Bluetooth device starts playing the audio data at the second time point t2; The subordinate Bluetooth device receives the Bluetooth data packet for the first time at its first time point t1' and receives the Bluetooth data packet correctly. According to the set delay time Δt=7*625 μs=4375 μs, the subordinate Bluetooth device also starts at its second time point t2' to play audio data. Since the Bluetooth clocks of the main and subordinate Bluetooth devices have been synchronized with the audio source clock respectively, the time point t1 at which the main and subordinate Bluetooth devices receive the audio data packets for the first time is aligned with the time point t1', and is set by the main and subordinate Bluetooth devices. The delayed playback time is the same, so the audio playback time points t2 and t2' obtained by the two are also aligned, so in this embodiment, the main Bluetooth device and the subordinate Bluetooth device realize synchronous playback of audio at the second time point t2 (t2');

(2) The main Bluetooth device receives for the first time and correctly receives the Bluetooth data packet at the first time point t1, and according to the set delay time Δt=7*625 μs=4375 μs, the main Bluetooth device starts playing the audio data at the second time point t2; The subordinate Bluetooth device receives for the first time at its first time point t1' but does not correctly receive the Bluetooth data packet, the audio source retransmits and the subordinate Bluetooth device correctly receives the Bluetooth data packet at its third time point t3', in accordance with the present invention, The time point t1' at which the subordinate Bluetooth device receives the Bluetooth data packet for the first time is determined as the first time point, so the delay Δt=7*625 μs=4375 μs is also delayed from the first time point t1', and the subordinate Bluetooth device also starts at the second time point t2' to play audio data. Since the Bluetooth clocks of the main and subordinate Bluetooth devices have been synchronized with the audio source clock respectively, the time point t1 at which the main and subordinate Bluetooth devices receive the audio data packets for the first time is aligned with the time point t1', and is set by the main and subordinate Bluetooth devices. The delayed playback time is the same, so the audio playback time points t2 and t2' obtained by the two are also aligned, so in this embodiment, the main Bluetooth device and the subordinate Bluetooth device also at the second time point t2 (t2') realize synchronous playback of audio data;

(3) The main Bluetooth device receives for the first time and correctly receives the Bluetooth data packet at the first time point t1, and according to the set delay time Δt=7*625 μs=4375 μs, the main Bluetooth device starts playing the audio data at the second time point t2; The subordinate Bluetooth device receives the Bluetooth packet for the first time at its first time point t1' but does not correctly receive the Bluetooth data packet, the audio source retransmits and the subordinate Bluetooth device correctly receives the Bluetooth data packet at its fourth time point t4', but at this time point t4', the time point is already later than the set time point t2', that is to say, the main Bluetooth device has started playing the to-be-played audio data at its second time point t2, and the subordinate Bluetooth device has been unable to play synchronously with the main Bluetooth device. Therefore, in this embodiment, the subordinate Bluetooth device will discard the audio data packet and no longer play it.

(4) The main Bluetooth device receives for the first time at its first time point t1 but does not correctly receive the Bluetooth data packet, the audio source retransmits and the main Bluetooth device correctly receives the Bluetooth data packet at its fourth time point t4; The subordinate Bluetooth device receives the Bluetooth packet for the first time at its first time point t1' but does not correctly receive the Bluetooth data packet, the audio source retransmits and the subordinate Bluetooth device correctly receives the Bluetooth data packet at its fourth time point t4'; in this embodiment, the main and subordinate Bluetooth devices receive the audio data. The time point t4 of the packet is later than the time point t2 (t2') of the originally scheduled synchronous play, so the main and subordinate Bluetooth devices will discard the audio data packet and no longer play.

Therefore, in combination with the above four implementation manners, since both the main and subordinate Bluetooth devices have the possible need of retransmitting data packets, as described in the third embodiment, the main Bluetooth device may receive correctly the audio data packet in the first audio transmission, and the subordinate Bluetooth device may correctly receive the audio data packet in the last retransmission. As described in the fourth embodiment, the main Bluetooth device and the subordinate Bluetooth device may both receive correctly the audio data pocket in the last retransmission. In order to avoid the time point when the audio data packet is correctly received is behind the set playing time point, one embodiment is to set the time length Δt of the delayed play time to be not less than the length of the Bluetooth time slot before the last retransmission, for example, the last retransmission in FIG. 3 is at time point t4, then the time length of Δt is greater than (t4-t1) is set, and a preferred embodiment is to directly set the length of the delayed play time Δt to be not less than the length of the fixed time interval (12 Bluetooth time slot lengths in this embodiment), so that the situation where the time point of receiving correctly the audio data is behind the set playing time point can be avoided.

In summary, the audio synchronization playing method disclosed in the above embodiments of the present invention can be separately performed in each wireless speaker connected to the audio source, that is, each wireless speaker is synchronized with the clocks of other wireless speakers, when the audio data sent by the audio source is received, the audio synchronous playback method of the embodiment of the present application is used for synchronous audio playback, and the data interaction between each wireless speaker is not required, so it can reduce the amount of data transmission between wireless speaker devices and power consumption of wireless speaker equipment, in addition, due to the unreliability of wireless transmission (main-subordinate transmission), the data transmission between the wireless devices is reduced, and the reliability of the system synchronous play is also improved. Moreover, the audio playing time point obtained by each wireless speaker is based on the time point at which the audio data packet (air signal) is received on the basis of the transceiver clock synchronization, and thus the synchronization precision is high.

It should be noted that although the operations of the method of the present invention are described in a particular order in the drawings, this is not required or implied that such operations must be performed in that particular order, or that all illustrated operations must be performed to achieve the desired results. Additionally, or alternatively, some steps may be omitted, multiple steps may be consolidated into one step, and/or a step may be decomposed into multiple steps.

Having described the methods of the exemplary embodiments of the present invention, an audio synchronization playing device according to an exemplary embodiment of the present invention will be described with reference to FIG. 9. For the implementation of the device, reference may be made to the implementation of the above methods, and the repeated description will not be repeated. The terms "module" and "unit" as used hereinafter may be software and/or hardware that implement a predetermined function.

Although the modules described in the following embodiments are preferably implemented in software, hardware, or a combination of software and hardware, is also possible and contemplated.

Figure 9:
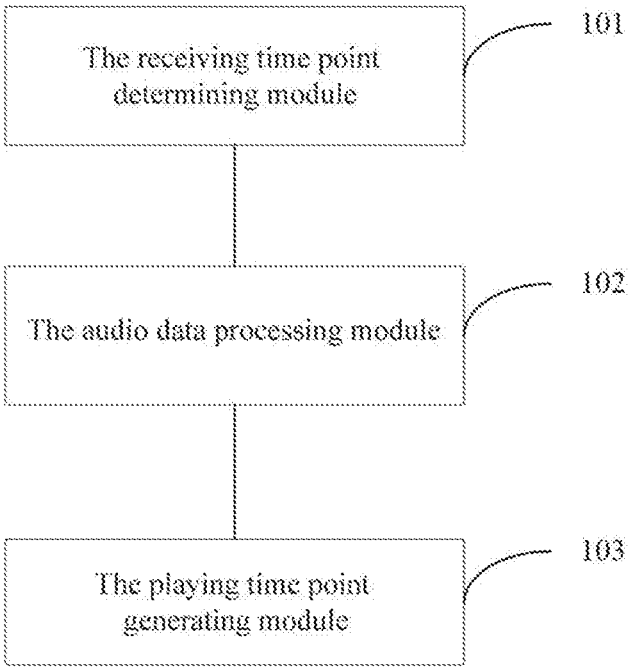
FIG. 9 is the structural diagram of the audio synchronization playing device in an embodiment of the present invention.

FIG. 9 is the structural diagram of the audio synchronization playing device in an embodiment of the present invention. As shown in FIG. 9, the audio synchronization playing device of this embodiment includes:

The receiving time point determining module 101, which is used to receive the first audio packet sent by the audio source and to determine the first time point of receiving the described first audio packet; Audio data processing module 102, which is used to process the first audio packet and generate the second audio packet, wherein the second audio data packet comprises audio data to be broadcast with a fixed data length; The playing time point generating module 103, which is used to set the delayed play time, obtain the playing time point of the second audio packet according to the first time point and the delayed play time, and play the audio data to-be-played in the second audio packet at the playing time point.

In some embodiments, the receiving time point determining module 101 receives the first audio data packet sent by the audio source, including: receiving the first audio data packet within a fixed time interval, and setting the maximum retransmission times of the first audio data within the fixed time interval.

In some embodiments, the receiving time point determining module 101 receives the first audio data packet sent by the audio source, including: setting the fixed time point within the fixed time interval, and receiving the described first audio data packet that is first transmitted or retransmitted.

In some embodiments, the receiving time point determining module 101 determines the first time point of receiving the first audio data packet, including: for any one of the two or more wireless speakers, setting the fixed time point of receiving the first audio data packet for the first time within the said fixed time interval as the first time point.

In some embodiments, the audio data processing module 102 processes the mentioned first audio data packet to generate a second audio data packet, including: performing data decompression processing on the first audio data packet, and generating a second audio data packet containing audio data to be broadcast with a fixed data length.

In some embodiments, the audio data processing module 102 sets a data length of the audio data to be played in the second audio data packet after the decompression to correspond with a time length of the described fixed time interval has been set; The length of the audio data played during the fixed time interval is equal to the data length of the audio data to be played in the second audio data packet.

In some embodiments, the playing time point generating module 103 sets the time delayed play time, including: set the time length of the time delayed play time to be not less than the length of time between the time point of the last retransmission of the first audio packet in the fixed time interval and the first time point.

In some embodiments, the playing time point generating module 103 obtains the playing time point of the second audio data packet according to the first time point and the delayed play time, including: from the first time point, delay the described delayed play time to obtain the playing time point of the second audio data packet.

In some embodiments, the audio synchronization playing device further include a transceiver clock synchronization module which is used to synchronize the transceiver clock of the wireless speaker with the audio source clock before receiving the first audio data packet sent by the audio source, thereby the clocks of all wireless speakers are indirectly synchronized.

In some embodiments, the playing time point generating module 103 includes:

An audio clock synchronization module used for synchronizing an audio clock with a transceiver clock;

And an audio data playing module used to play the audio data to be played according to the audio clock.

In some embodiments, there are two or more wireless speakers that establish a wireless connection with the audio source; the wireless connection includes ordinary Bluetooth, Bluetooth low energy, physical layer improved Bluetooth, WIFI and any of one or several forms of the near field communication.

In some embodiments, the described two or more wireless speakers include a main wireless speaker and a subordinate wireless speaker; wherein, the main wireless speaker not only establishes the first Bluetooth connection with the audio source, but also establishes a second Bluetooth connection with the subordinate wireless speaker; the main wireless speaker transmits the relevant parameters of the first Bluetooth connection to the subordinate wireless speaker to cause the subordinate wireless speaker to intercept and receive the audio source data packet from the audio source.

Moreover, although several units of the audio synchronization playing device are mentioned in the above detailed description, such division is merely not mandatory. Indeed, in accordance with embodiments of the present invention, the features and functions of two or more units described above may be embodied in one unit. Also, the features and functions of one unit described above may be further subdivided into multiple units to externalize.

Figure 10:
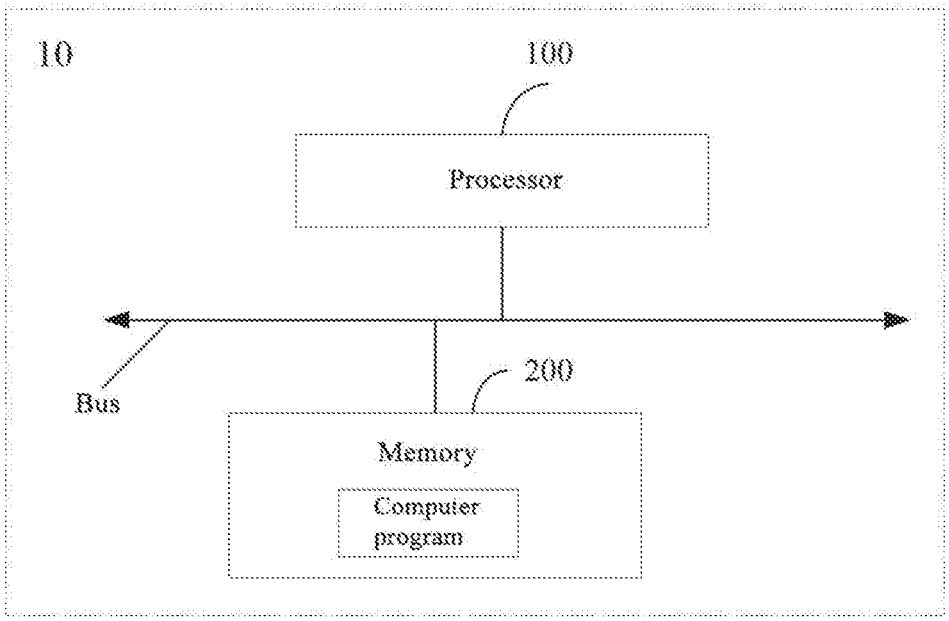
FIG. 10 is the structural diagram of a wireless speaker device in an embodiment of the present invention.

FIG. 10 is the structural diagram of the wireless speaker device in an embodiment of the present invention. As shown in FIG. 10, the wireless speaker device 10 can include a processor 100 and a memory 200 coupled to the processor 100. Wherein the memory 200 can store various data; in addition, a program for information processing is stored and the program is executed under the control of the processor 100 to receive various information transmitted by the external terminal device, and to transmit the request information to the external terminal device, etc.

In one embodiment, the functionality of the audio synchronization playing device shown in FIG. 9 can be integrated into the processor 100. The processor 100 may be configured to: receive a first audio data packet sent by the audio source and determine the first time point to receive the first audio data packet; process the first audio data packet to generate a second audio data packet containing audio data to be broadcast with a fixed data length; set a delayed playback time and obtain the playing time point of the second audio data packet according to the first time point and the delayed play time, and play the audio data to be played in the second audio data packet at the playing time point.

In another embodiment, the audio synchronization playing device shown in FIG. 9 may be configured separately from the processor 100. For example, the audio synchronization playback device may be configured as a chip which is connected to the processor 100 and the function of the audio synchronization playing device is implemented by the control of the processor 100.

Figure 11:
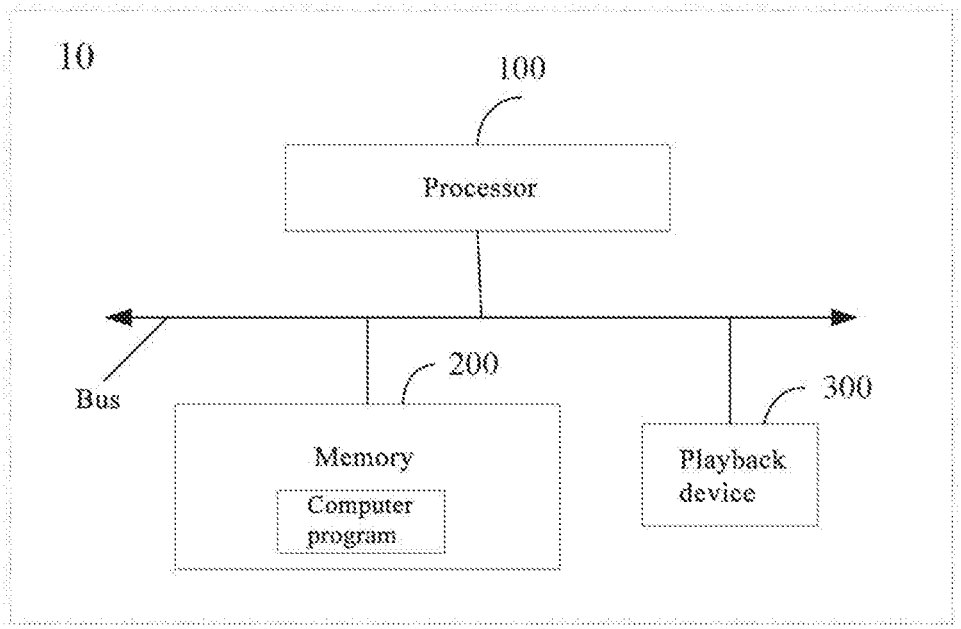
FIG. 11 is the structural diagram of a wireless speaker device in another embodiment of the present invention.

In addition, as shown in FIG. 11, the wireless speaker devices may further include the playback device 300. The playback device is coupled to the processor 100. After the processor 100 obtains the playing time point of the second audio data packet, the playing device 300 plays the audio data to be played in the second audio data packet at the playing time point. The function of the playback device 300 may be similar to the prior technology, and details are not described herein again. It is to be noted that the wireless speaker device does not necessarily have to include all of the components shown in FIG. 11; in addition, the wireless speaker device may also include the components not shown in FIG. 11, and reference may be made to the prior technology.

Figure 12:
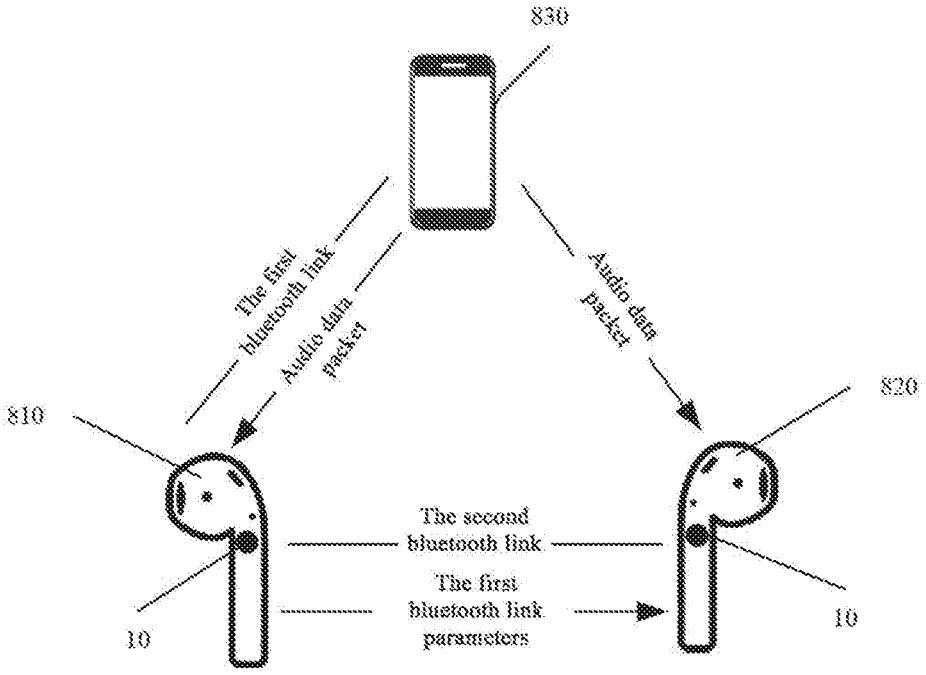
FIG. 12 is the structural diagram of the wireless headset in an embodiment of the present invention.

FIG. 12 is the structural diagram of the wireless headset in an embodiment of the present invention. As shown in FIG. 12, the wireless headset of the present embodiment includes a main headset 810 and a subordinate headset 820. The main headset 810 and the audio source 830 (in this embodiment, the smart terminal 830) establish the first Bluetooth connection, and the main headset 810 establishes the second Bluetooth connection with the subordinate headset 820; the main headset 810 transmits the relevant parameters of the first Bluetooth connection to the subordinate headset 820. the subordinate headset 820 intercepts and receives the audio data packets from the audio source 830 and can "disguise as" the main headset 810 to communicate with the audio source 830. Both the main headset 810 and the subordinate headset 820 can directly receive the audio data packet sent by the audio source 830. Further, the main headset 810 and the subordinate headset 820 each include the wireless speaker device 10 as shown in FIG. 10 or FIG. 11. The processor 100 included in the wireless speaker device 10 can synchronize playback of the main headset 810 and the subordinate headset 820.

The audio synchronization playing method disclosed in the embodiments of the present invention can be separately performed in each wireless speaker connected to the audio source, that is, each wireless speaker is synchronized with the clocks of other wireless speakers, when the audio data sent by the audio source is received, the audio synchronous playing method of the embodiment of the present application is used for synchronous audio play, and the data interaction between each wireless speaker is not required, so it can reduce the amount of data transmission between wireless speaker devices and power consumption of wireless speaker equipment, in addition, due to the unreliability of wireless transmission (main-subordinate transmission), the data transmission between the wireless devices is reduced, and the reliability of the system synchronous playback is also improved. Moreover, the audio playing time point obtained by each wireless speaker is based on the time point at which the audio data packet (air signal) is received on the basis of the transceiver clock synchronization, and thus the synchronization precision is high.

The technical personnel in the field shall be aware that embodiments of the present invention can be provided as methods, systems or computer program products. Accordingly, the present invention can take the form of an entirely hardware embodiment, an entirely software embodiment, or an embodiment combining of software and hardware. Moreover, the present invention can adopt the form of a computer program product which includes one or more computer usable program code and can be embodied on computer-usable storage media (including but not limited to disk storage, CD-ROM, optical storage, etc.).

The present invention has been described with reference to flowchart illustrations and/or block diagrams of methods, apparatus (system), and computer program products according to embodiments of the present invention. It shall be understood that the combination of each flow and/or box in the flowchart and/or block diagram and the flow and/or box in the flowchart and/or block diagram can be implemented by computer program instructions. These computer program instructions can be provided to a processor of a general purpose computer, special purpose computer, embedded processor, or other programmable data processing device to form a machine, so that the execution of instructions sent by a processor of a computer or other programmable data processing device to use for implementing the functions specified in one or more of the flow or in a block or blocks of the flow chart.

The computer program instructions can also be stored in a computer readable memory that can direct a computer or other programmable data processing device to operate in a particular manner, such that the instructions stored in the computer readable memory produce an article of manufacture comprising the instruction device. The apparatus implements the functions specified in one or more blocks of a flow or a flow and/or block diagram of the flowchart.

These computer program instructions can also be loaded onto a computer or other programmable data processing device, so that a series of operational steps are performed on a computer or other programmable device to produce computer-implemented processing for execution on a computer or other programmable device. Thus, instructions executed on a computer or other programmable device provide steps for the implementation of functions specified in a flow or flows of a flowchart and/or a box or boxes of a block diagram.

The principles and mode of execution of the present invention have been described in connection with the specific embodiments that the description of the above embodiments is only used for understanding of the method of the present invention and the core idea thereof. At the same time, for those technical personnel in the field, according to the idea of the present invention, there will be changes in the specific implementation mode and application scope. To sum up, the contents of the specification should not be interpreted as restrictions on the present invention.

What is claimed is:

1. An audio synchronous playing method for realizing synchronous playing of audio data from an audio source by two or more wireless speakers, comprising:

receiving at each of the two or more wireless speakers first audio data packets sent by the audio source and determining a respective first time point for the receiving of the first audio data packets;

processing the first audio data packets at each of the two or more wireless speakers to generate respective second audio data packets, wherein the second audio data packets each include audio data to be played with a fixed data length;

setting a delayed play time and obtaining a playing time point at each of the two or more wireless speakers, the obtaining of the playing time point being based on the respective first time point and the respective delayed play time; and playing the second audio data packets at each of the two or more wireless speakers at the respective playing time point, wherein obtaining of the playing time point includes setting the playing time point to be a time point after the first time point and separated from the first time point by the delayed play time.

2. The audio synchronous playing method of claim 1, wherein the receiving of the first audio data packets includes:

receiving the first audio data packets within a fixed time interval, and setting a maximum number for retransmission of the first audio data packets within the fixed time interval, wherein the receiving of the first audio data packets within the fixed time interval includes receiving the first audio data packets initially sent by or retransmitted by the audio source within the fixed time interval.

3. The audio synchronous playing method of claim 2, wherein the receiving of the first audio data packets further includes:

setting fixed time points within the fixed time interval, and receiving the first audio data packets at the fixed time points.

4. The audio synchronous playing method of claim 3, wherein the determining of the respective first time point includes choosing the first time point to be a fixed time point at which the first audio data packet is first received.

5. The audio synchronous playing method of claim 2, wherein the processing of the first audio data packets includes performing data decompression processing on the first audio data packets.

6. The audio synchronous playing method of claim 5, wherein:

a data length of audio data played in the fixed time interval is equal to the fixed data length.

7. The audio synchronous playing method of claim 2, wherein the setting of the delayed play time includes setting a time length of the delayed play time to be not less than a time length between a time point at which the first audio data packets are last retransmitted within the fixed time interval and the first time point.

8. The audio synchronous playing method of claim 1 further comprising, before receiving the first audio data packets, synchronizing transceiver clocks of the two or more wireless speakers.

9. The method of claim 8, wherein the synchronizing includes synchronizing each of the transceiver clocks of the two or more wireless speakers with a transceiver clock of the audio source.

10. The audio synchronous playing method of claim 8, wherein the playing of the audio data to be played at each of the two or more wireless speakers includes:

synchronizing an audio clock of the each of the two or more wireless speakers with its respective transceiver clock; and playing the audio data to be played according to the audio clock.

11. The audio synchronous playing method of claim 1, wherein each of the two or more wireless speakers establish a wireless link with the audio source, the wireless link selected from an ordinary Bluetooth, Bluetooth Low Energy, WIFI, or near-field communication.

12. The audio synchronous playing method of claim 1, wherein:

the two or more wireless speakers include a main wireless speaker and a subordinate wireless speaker;

the main wireless speaker establishes a first Bluetooth link with the audio source, the main wireless speaker establishes a second Bluetooth link with the subordinate wireless speaker; and the main wireless speaker transmits parameters of the first Bluetooth link to the subordinate wireless speaker such that the subordinate wireless speaker intercepts and receives the first audio data packets from the audio source using the parameters.

13. The method of claim 1, wherein the receiving, determining, processing, setting, obtaining, and playing at a first wireless speaker of the two or more wireless speakers is performed independently from the receiving, determining, processing, setting, obtaining, and playing at a second wireless speaker of the two or more wireless speakers, respectively.

14. The audio synchronous playing method of claim 1, wherein the second audio data packets generated from the processing of the first audio data packets further include information about the first time point in a blank field of the second audio data packets.

15. An audio synchronous playing device for realizing synchronous playback of audio data from an audio source by two or more wireless speakers, comprising:

a receiving time point determining module for receiving a first audio data packet sent by the audio source and determining a first time point for the receiving of the first audio data packet, wherein the first audio data packet sent by the audio source is retransmitted one or more times and the first time point is determined to be a time point at which the first audio data packet is initially received;

an audio data processing module for processing the first audio data packet to generate a second audio data packet, wherein the second audio data packet includes audio data to be played with a fixed data length; and a playing time point generating module for setting a delayed play time, obtaining a playing time point for the second audio data packet according to the first time point and the delayed play time, and playing the audio data to be played at the playing time point.

16. The audio synchronous playing device of claim 15, wherein the playing time point generating module sets a time length of the delayed play time to be greater than a time separation between a first time at which the first audio data packet is first sent by the audio source and a last time at which the first audio data packet is retransmitted.

17. The audio synchronous playing device of claim 15, wherein the first audio data packet sent by the audio source is retransmitted according to a set maximum retransmission number N regardless of whether the receiving time point determining module correctly receives the first audio data packet.

18. A wireless speaker system comprising a plurality of wireless speakers, wherein each of the plurality of wireless speakers include:

a processor, wherein the processor:

receives from an audio source a first audio data packet, wherein the first audio data packet is received multiple times within a fixed time interval;

determines a first time point at which the first audio data packet is received;

processes the first audio data packet to generate a second audio data packet, the second audio data packet including audio data to be played of a fixed data length;

sets a delayed play time to have a time duration that is not less than a time length between the first time point and a time point at which the first audio data packet is received for the last time within the fixed time interval; and determines a playing time point based on the first time point and the delayed play time; and a playback device coupled to the processor, wherein the playback device receives the playing time point from the processor and plays the audio data to be played at the playing time point.

19. The wireless speaker system of claim 18, wherein the processor of each of the plurality of wireless speakers determines the first time point to be a time point at which the first audio data packet is initially received.

20. The wireless speaker system of claim 18, wherein:

the processor of each of the plurality of wireless speakers receive, determine, process, set, and determine independently from each other, and the playback device of each of the plurality of wireless speakers receive and play independently from each other.

* * * * *